US005596774A

United States Patent [19]

Howard

[11] Patent Number: 5,596,774

[45] Date of Patent: Jan. 28, 1997

[54] SELF CLEANING TOILET

[76] Inventor: Frederick T. Howard, 4111 Russell Ave., #2, Mt. Rainier, Md. 20712

[21] Appl. No.: 490,760

[22] Filed: Jun. 15, 1995

[51] Int. Cl.[6] ..... E03D 11/02

[52] U.S. Cl. ..... 4/420; 4/233

[58] Field of Search ..... 4/420, 591, 662, 4/233

[56] References Cited

U.S. PATENT DOCUMENTS

| | | | |
|---|---|---|---|
| 260,967 | 7/1882 | Frey | 4/420 |
| 275,900 | 4/1883 | Frey | 4/420 |
| 1,468,565 | 9/1923 | Guth | 4/662 X |
| 4,063,316 | 12/1977 | Hunninghaus | 4/662 X |
| 4,980,931 | 1/1991 | Meisels | 4/233 |

FOREIGN PATENT DOCUMENTS

| | | | |
|---|---|---|---|
| 4021866 | 9/1994 | WIPO | 4/662 |

*Primary Examiner*—Charles E. Phillips
*Attorney, Agent, or Firm*—Chenpatents

[57] ABSTRACT

A toilet bowl has a self-cleaning hollow rim with openings in the top surface of the rim whereby urine and other residues accumulating thereon are rinsed during flushing of the toilet. The water drains into a trough along the periphery of the bowl and into the toilet bowl.

13 Claims, 2 Drawing Sheets

SELF CLEANING TOILET

I. BACKGROUND OF THE INVENTION

1. Field of Invention

Figure 1:
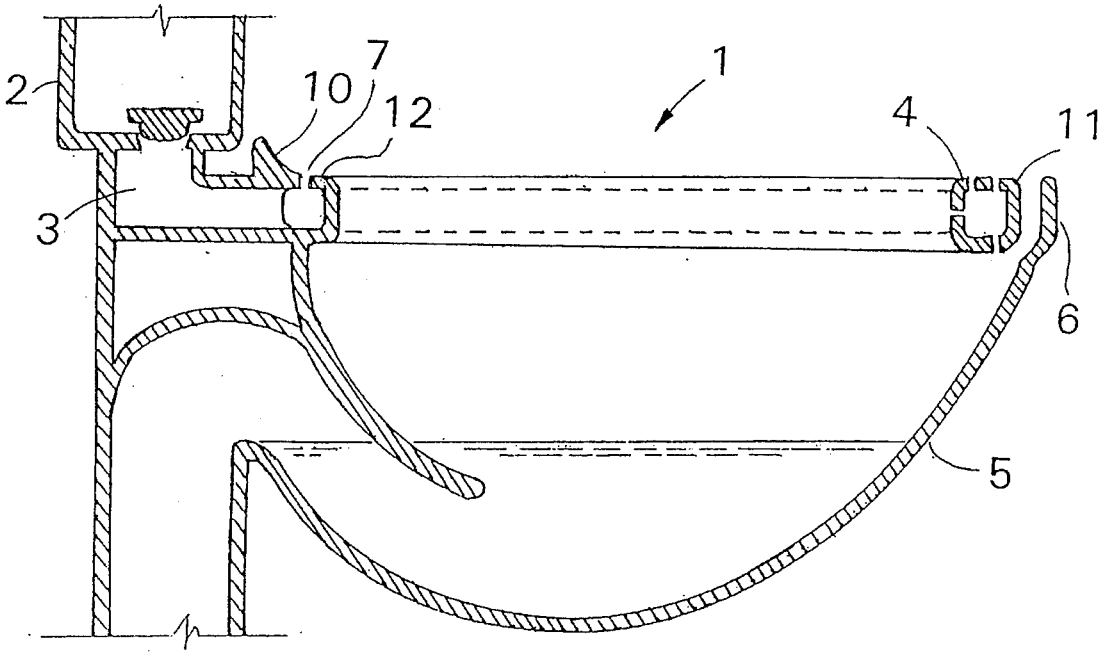

This invention relates to a self-cleaning toilet, and in particular, a toilet having means for flushing the rim of the toilet bowl.

2. Prior Art

A conventional toilet provides water for flushing wastes flowing from a water tank to the toilet bowl through an opening near the bottom of the bowl and a plurality of openings on the underside of the rim of the toilet bowl. The former may impart a swirling motion to the water flowing into the bowl, and the openings on the underside of the hollow rim provide rinsing action. No provision for rinsing urine and other residues from the rim of the toilet bowl during flushing is known to the art at this time. The cleaning of the rim of the toilet bowl must be done manually at the present time.

Self-rinsing toilet bowls are known in the prior art. U.S. Pat. No. 4,987,616 discloses a toilet having water flowing from under the rim so as to cause a vortex action at the discharge end of the bowl. Similarly, U.S. Pat. No. 2,164,319 shows a toilet having a toilet seat with a water flushing structure attached to its underside having a plurality of openings for ejecting water to scour the inner surface of the bowl. U.S. Pat. No. 3,919,716 discloses a toilet with a spray device for cleaning the bowl when the latter is tilted into a cleaning position. Both U.S. Pat. Nos. 3,484,873 and 5,170,515 show toilets having rims with openings for discharging water into the bowl. None of the toilets in the prior art have means for rinsing the top surface of the toilet bowl rim, which tends to accumulate urine and other residues and which are unpleasant to remove manually. Thus there is a need for an improved toilet having means for rinsing the rim surfaces of the toilet bowl during flushing.

A toilet bowl as referred to herein shall mean any receptacle for temporarily receiving human wastes connected to a water supply and means of releasing water into the toilet bowl for flushing out such wastes.

II. SUMMARY OF THE INVENTION

In accordance with the present invention, a toilet bowl having a conventional water distribution system with means for releasing water for flushing, comprises a hollow rim in communication with the water supply, with a plurality of openings on the upper surface of the rim, including the rear portion of the upper surface which connects to the seat. A trough around the exterior periphery of the rim is provided to catch the flushing water discharged through the openings in the upper surface of the hollow rim. Both the rim and the trough are integral with the bowl and have drain openings on the underside enabling the flushing water to drain into the bowl. These drain openings have sufficient cross-sectional area to accommodate the maximum water flow rate from the water tank without overflowing of the trough.

During flushing of the toilet, water from the toilet tank flows into the hollow rim and discharges through the openings in the top surface of the rim, flushing away wastes accumulated on the rim, and flows into the trough and, through drain holes or slots at the bottom of the trough, into the interior of the bowl. A portion of the water discharging from the openings in the top surface of the rim overflows by way of an interior wall of the rim aiding cleaning of said wall and draining directly into the bowl. The rim and the interior of the bowl are thus rinsed during the flushing of the toilet.

It is the object of this invention to provide a toilet with a self-cleaning rim. It is a further object of this invention to provide a simple design of a toilet eliminating the necessity for manual removal of urine and other residues from the rim of the toilet. These together with the various ancillary objects and features of the invention will become apparent by reading the following detailed description of the invention in conjunction with the drawings.

III. BRIEF DESCRIPTION OF THE DRAWINGS

Figure 2:
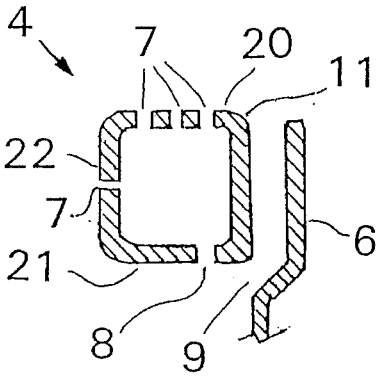
Figure 3:
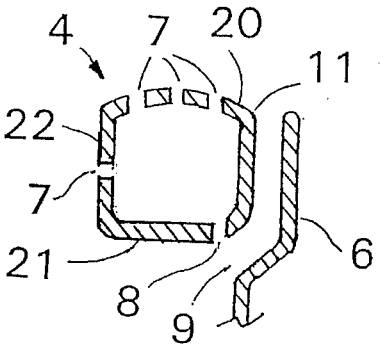
Figure 4:
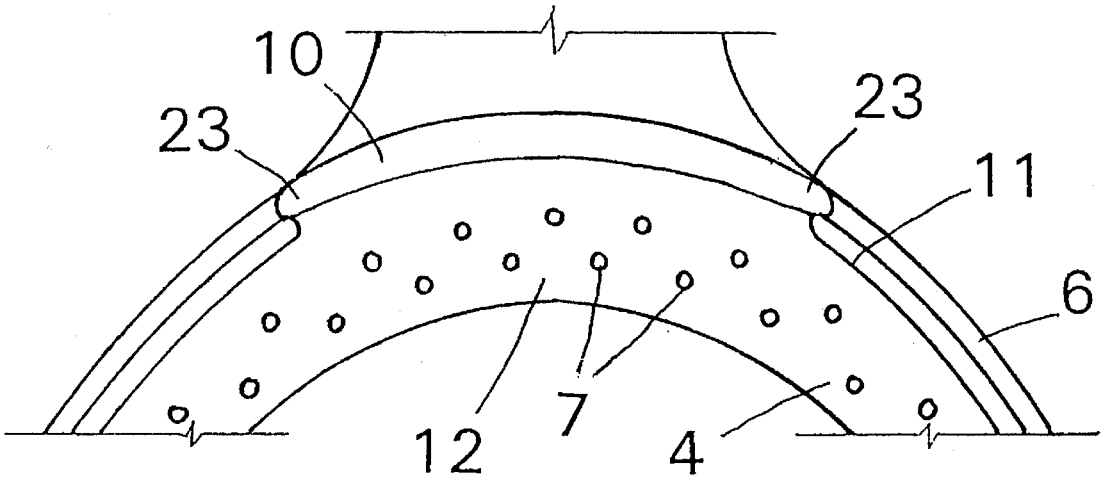

FIG. 1 is a elevational cross-section of the toilet bowl. FIG. 2 is an enlarged elevational cross section of the rim of the toilet bowl. FIG. 3 shows an alternative embodiment of the rim in elevational cross section. FIG. 4 is a partial plan view of the rear portion of the rim.

IV. DETAILED DESCRIPTION OF THE INVENTION

With reference to FIG. 1, a toilet 1 has a water supply tank 2 with means for releasing the water into the toilet bowl 5 by way of a passage 3 which communicates with a hollow toilet bowl rim 4. The rim connects to a rear portion 12 where a toilet seat (not illustrated) is pivotably connected.

The hollow rim as shown in FIG. 2 has a rectangular cross section. However, this invention is not limited to this shape. Any configuration allowing the draining of water from the upper surface of the rim is suitable. FIG. 3 shows an alternative configuration of the rim having a top surface 20 which is convex upward.

With reference to FIGS. 2 and 3, the hollow rim 4 has openings 7 in its upper surface 20, including the rear portion 12 of the rim shown in FIG. 4. Optionally, as shown in FIGS. 2 and 3, openings may also be provided on the interior side wall 22 of the rim 4. On the underside, or lower wall 21 of the rim 4, there is a plurality of openings 8, adjacent to the toilet bowl 5 for flushing the contents of the toilet. A trough 6 has drain holes or optionally, drain slots, 9, for flushing the water intercepted from the upper surface 20 of rim 4, into the bowl.

The trough 6 extends along the exterior periphery 11, of the rim, at approximately the same elevation as the rim 4, and terminating at the rear portion 12. On the rear portion 12 of the rim 4, in order to prevent water flowing from the openings 7 from spilling on the floor where the trough terminates, a shallow dam 10 is provided, as shown in FIG. 4, with two opposing ends 23 extending to the exterior periphery 11 towards to the trough 6, directing the rinsing water towards the sides of rim 4 and into the trough 6 and towards the bowl 5.

The openings 7 and 8 in the top and bottom surfaces of the rim 4, and the openings 7 in the rear portion 12 of the rim, range in diameter from about 1/16" to 1/4". Preferably, the cross sectional area of the openings 8 is greater than that of the openings 7. The openings 7 are spaced along the top surface 20 and the rear portion 12 of the rim 4 about 1/4" to 2" apart, in one to three rows, preferably staggered. Only one row of openings 8 on the underside wall 21 is required. The trough 6 has a width of about 1/2" to 3/4", and the drain holes or slots 9 have a a minimum dimension of 1/4".

When the toilet is flushed, the water in the water supply tank 2 is released into passage 3, which comunicates with the hollow toilet rim 4. Water is discharged through the openings 7 in the upper surface 20 of the rim 4 and the upper surface of the rear portion 12. This water flows over the top surface 20 of the rim, rinsing away urine and other residues accumulated thereon. The water flowing outwardly over the top of the rim overflows and drains along the exterior periphery 11 of the rim into the trough 6 and drains into the toilet bowl through drain holes or slots 9. Water that flows inwardly over the top of the rim drains directly over the interior side wall 22, into the toilet bowl, cleaning the wall 22. In addition, a portion of the water is discharged into the toilet bowl through the drain holes 8 in the bottom surface 21 of the rim 4, rinsing the inside of the toilet bowl. Water released through the openings 7 in the rear portion 12 of the rim is directed by the dam 10 into the trough 6 and is thus prevented from spilling on the floor.

Due to the simplicity of design of this invention, the toilet of this invention can be used commercially or in private homes. No discussion of the mechanical flushing system, discharging mechanism, and water distribution piping is necessary since these are not part of the invention.

Numerous modifications and variations of the present invention are possible in light of the above teaching, and therefore, within the scope of the appended claims; the invention may be practiced otherwise than as particularly described.

What is claimed is:

1. A toilet bowl with a self-cleaning rim for use with a flush water supply, said self-cleaning rim comprising, a hollow rim surrounding a periphery of the toilet bowl, said rim having a top surface with a first plurality of openings arranged therein for directing water to flow upwardly from the hollow rim through said openings; a trough integral with the bowl and spaced away from and outside the rim, for intercepting water overflowing from said top surface and a second plurality of openings provided at a bottom of the trough, for draining water from the trough into the toilet bowl; whereby the rim is cleaned by the water issuing from the first plurality of openings.

2. The toilet bowl of claim 1 further comprising a rear portion of the rim having the first plurality of openings, whereby the rear portion of the rim is cleaned.

3. The toilet bowl of claim 2 further comprising a dam in the shape of semicircle fixed on the rear portion, said dam having two opposing ends extending outwardly to outer edges of the rim for directing rinsed water from said first openings to the trough.

4. The toilet bowl of claim 1 wherein the rim has a convex top surface.

5. The toilet bowl of claim 4 wherein the first plurality of openings has a diameter from about 1/16 to 1/4 inches.

6. The toilet bowl of claim 5 wherein the first plurality of openings is arranged in from one to three rows.

7. The toilet bowl of claim 1 wherein the width of the trough is from about 1/2 to about 3/4 inches and is at approximately the same level as the rim.

8. The toilet bowl of claim 1 wherein the cross section of the hollow rim is rectangular.

9. The toilet bowl of claim 1 wherein the rim further comprises a lower wall having one row of a third plurality of openings for flushing the bowl.

10. The toilet bowl of claim 1 wherein the rim further comprises an interior side wall having the first plurality of openings.

11. The toilet bowl of claim 1 wherein the diameters of the second plurality of openings are at least 1/4 inch.

12. The toilet bowl of claim 11 wheren the second plurality of openings is arranged in one row.

13. A toilet bowl with a self-cleaning rim for use with a flush water supply, said self-cleaning rim comprising, a hollow rim surrounding a periphery of the toilet bowl, said rim having a top surface with a first plurality of openings arranged therein for directing water to flow upwardly from the hollow rim through said openings; a rear portion of the rim provided with said first plurality of openings; a dam fixed on the rear portion for directing water into the bowl; a trough integral with the bowl and spaced away from and outside the rim, for intercepting water overflowing from said top surface, and a second plurality of openings provided at a bottom of the trough for discharging water, said latter openings being at least 1/4 inch in diameter, for draining water from the trough into the toilet bowl; whereby the rim including the rear portion thereof is cleaned by the water issuing from the first plurality of openings.

* * * * *